US008704458B2

(12) United States Patent
Sun et al.

(10) Patent No.: US 8,704,458 B2
(45) Date of Patent: Apr. 22, 2014

(54) LIGHT EMITTING SYSTEM CAPABLE OF COLOR TEMPERATURE STABILIZATION

(75) Inventors: Tai-Ping Sun, Jhongli (TW); Chia-Hung Wang, Taichung (TW)

(73) Assignee: National Chi Nan University, Puli, Nantou (TW)

( * ) Notice: Subject to any disclaimer, the term of this patent is extended or adjusted under 35 U.S.C. 154(b) by 190 days.

(21) Appl. No.: 13/433,774

(22) Filed: Mar. 29, 2012

(65) Prior Publication Data

US 2013/0088167 A1 Apr. 11, 2013

(30) Foreign Application Priority Data

Oct. 7, 2011 (TW) ..... 100136490 A

(51) Int. Cl.
*H05B 37/02* (2006.01)

(52) U.S. Cl.
USPC ..... 315/297; 315/291; 315/307; 315/309; 315/312

(58) Field of Classification Search
USPC ..... 315/149, 150, 209 R, 291, 297, 307, 315/309, 312
See application file for complete search history.

(56) References Cited

U.S. PATENT DOCUMENTS

2007/0200513 A1* 8/2007 Ha et al. ..... 315/309
2010/0259182 A1* 10/2010 Man et al. ..... 315/250

OTHER PUBLICATIONS

Taiwan Patent and Trademark Office, Reference in Office Action issued to TW Counterpart Application No. 100136490 on Dec. 20, 2013, and English Abstract.

* cited by examiner

*Primary Examiner* — Douglas W Owens
*Assistant Examiner* — Thai Pham
(74) *Attorney, Agent, or Firm* — Shook Hardy Bacon, LLP

(57) ABSTRACT

A light emitting system includes: first, second, and reference light emitting components having first, second, and reference forward voltages when driven under constant current, respectively; an instrumentation amplifier for generating a temperature detection voltage with a magnitude dependent on the reference forward voltage of the reference light emitting component; first and second compensation voltage modules each generating a respective one of first and second compensation voltages based at least on the temperature detection voltage; and first and second power control modules providing first and second driving currents through the first and second light emitting components according to the first and second compensation voltages and the first and second forward voltages, respectively.

14 Claims, 5 Drawing Sheets

LIGHT EMITTING SYSTEM CAPABLE OF COLOR TEMPERATURE STABILIZATION

CROSS-REFERENCE TO RELATED APPLICATION

This application claims priority of Taiwanese Application No. 100136490, filed on Oct. 7, 2011.

BACKGROUND OF THE INVENTION

1. Field of the Invention

The present invention relates to a light emitting system, more particularly to a light emitting system capable of color temperature stabilization.

2. Description of the Related Art

A light emitting module capable of emitting white light typically includes red, green, and blue light emitting diodes (LEDs), and has a color mixing ratio dependent on a light emitting power and hence a forward voltage of each of the LEDs. Since the forward voltage of each of the LEDs is in a negative relation to the ambient temperature, the light emitting power, or a product of the forward voltage and an operating current, of each of the LEDs is also in a negative relation to the ambient temperature. Furthermore, since each of the primary-color LEDs has a relationship between light emitting power and ambient temperature different from those of the other primary-color LEDs, the color mixing ratio and hence the color temperature of the light emitting module may vary with the ambient temperature as shown in FIG. 1 due to the inconsistency among the aforesaid relationships between light emitting power and ambient temperature. Therefore, the light emitting power of each of the LEDs must be stabilized with respect to the ambient temperature in order to stabilize the color temperature of the light emitting module.

Referring to FIG. 2, Taiwanese Patent Application No. 92107029 discloses a conventional light emitting power control circuit 1 for controlling a light emitting power of an LED 15 (e.g., a laser light emitting diode) in an optical pick-up of an optical drive device. The conventional light emitting power control circuit 1 includes a detection module 10, a signal source 11, an integration module 12, and a driving module 13.

The detection module 10 is operable to receive light emitted from the LED 15 and to detect the light emitting power of the LED 15 so as to generate a detection voltage (V3) having a magnitude that is in a positive relation to the light emitting power detected by the detection module 10. The light emitting power is defined by the equation of $P=V_F\times 1$, where P, $V_F$, and I are the light emitting power, a forward voltage, and an operating current of the LED 15, respectively.

The detection module 10 includes a light detector 101 and a front-end amplifier 102. Since a description of the operations of these components may be found in the specification of the aforesaid Taiwanese Application, these components will not be described hereinafter for the sake of brevity.

The signal source 11 is operable to generate a reference voltage (V1) that has a magnitude greater than that of the detection voltage (V3) and dynamically configurable according to a target light emitting power.

The integration module 12 is connected electrically to the signal source 11 and the detection module 10 for respectively receiving the reference voltage (V1) and the detection voltage (V3) therefrom, and is operable to output an integration voltage (V2) based on an integration of a difference between the reference voltage (V1) and the detection voltage (V3). When the detection voltage (V3) is reduced as a result of a reduction in the light emitting power, the difference between the reference voltage (V1) and the detection voltage (V3) is increased, causing the integration voltage (V2) to increase. On the other hand, when the detection voltage (V3) is increased as a result of an increase in the light emitting power, the difference between the reference voltage (V1) and the detection voltage (V3) is decreased, causing the integration voltage (V2) to decrease.

The driving module 13 is connected electrically to the integration module 12 for receiving the integration voltage (V2) therefrom, and is connected electrically to the LED 15 for providing to the LED 15 the operating current having a magnitude that is in a positive relation to the integration voltage (V2) received by the driving module 13. The driving module 13 includes an amplifier 131 having an adjustable gain, and a driving unit 132 electrically connected electrically to the amplifier 131. Since a description of the operations of these components may be found in the specification of the aforesaid Taiwanese Application, these components will not be described hereinafter for the sake of brevity.

When the forward voltage of the LED 15 is decreased as a result of an increase in the ambient temperature, the light emitting power is reduced, the detection voltage (V3) generated by the detection module 10 is decreased while the reference voltage (V1) remains unchanged, and the difference between the reference voltage (V1) and the detection voltage (V3) is thus increased such that the integration voltage (V2) and hence the operating current are, as a result, increased. This increase in the operating current serves to compensate for the reduction in the forward voltage, thereby achieving a light emitting power stabilization effect.

It can be understood from the above that the conventional light emitting power control circuit 1 stabilizes the light emitting power through adjusting the operating current according to variations in the detection voltage (V3), which correspond to variations in light detected by the light detector 101 of the detection module 10. However, since the LED 15 suffers from poor directivity, factors such as distance between and positions of the light detector 101 and the LED 15, ambient light pollution, and sensitivity of the light detector 101 may cause errors in stabilization of the light emitting power, such that the conventional light emitting power control circuit 1 may not be able to effectively stabilize the light emitting power of the LED 15 in response to variations in the ambient temperature.

Furthermore, when used with the abovementioned light emitting module, the conventional light emitting power control circuit 1 may be unable to effectively stabilize the light emitting power of each of the primary-color LEDs in response to variations in the ambient temperature, resulting in a poor color mixing ratio stabilization effect and hence a poor color temperature stabilization effect.

SUMMARY OF THE INVENTION

Therefore, an object of the present invention is to provide a light emitting system capable of alleviating the aforesaid drawbacks of the prior art.

According to the present invention, a light emitting system with color temperature stabilization includes:

a light emitting module including a first solid-state light emitting component of a first primary color, the first solid-state light emitting component having an anode and a cathode, one of which is disposed to receive an input voltage, and having a first forward voltage that has a magnitude dependent on ambient temperature when driven under a constant current condition, and a second solid-state light emitting component of a second primary color, the second solid-state light emitting component having an anode and a cathode, one of which is disposed to receive the input voltage, and having a second forward voltage that has a magnitude dependent on the ambient temperature when driven under a constant current condition; and a color temperature control device including a reference solid-state light emitting component having an anode and a cathode, one of which is disposed to receive the input voltage, and having a reference forward voltage that has a magnitude dependent on the ambient temperature when driven under a constant current condition, and a color temperature control circuit including a detection module including a current source that is connected electrically to the other of the anode and the cathode of the reference solid-state light emitting component for providing a constant operating current through the reference solid-state light emitting component, and a first instrumentation amplifier that has first and second input terminals connected electrically and respectively to the anode and the cathode of the reference solid-state light emitting component for detecting the reference forward voltage, and an output terminal for outputting a temperature detection voltage generated by the first instrumentation amplifier according to the reference forward voltage detected by the first instrumentation amplifier, the temperature detection voltage having a magnitude that is dependent on the reference forward voltage detected by the first instrumentation amplifier, a first compensation voltage module connected electrically to the detection module for receiving the temperature detection voltage from the detection module, adapted to receive first and second reference voltages, and operable to generate a first compensation voltage based on a gain of the first compensation voltage module, the temperature detection voltage and the first and second reference voltages received by the first compensation voltage module, the first compensation voltage being related to the reference forward voltage, a second compensation voltage module connected electrically to the detection module for receiving the temperature detection voltage from the detection module, adapted to receive the first and second reference voltages, and operable to generate a second compensation voltage based on a gain of the second compensation voltage module, the temperature detection voltage and the first and second reference voltages received by the second compensation voltage module, the second compensation voltage being related to the reference forward voltage, a first power control module connected electrically to the first compensation voltage module for receiving the first compensation voltage from the first compensation voltage module, connected electrically to the anode and the cathode of the first solid-state light emitting component for detecting the first forward voltage, and operable to provide a first driving current through the first solid-state light emitting component according to the first compensation voltage and the first forward voltage received and detected by the first power control module for stabilizing a light emitting power of the first solid-state light emitting component with respect to the ambient temperature, and a second power control module connected electrically to the second compensation voltage module for receiving the second compensation voltage from the second compensation voltage module, connected electrically to the anode and the cathode of the second solid-state light emitting component for detecting the second forward voltage, and operable to provide a second driving current through the second solid-state light emitting component according to the second compensation voltage and the second forward voltage received and detected by the second power control module for stabilizing a light emitting power of the second solid-state light emitting component with respect to the ambient temperature.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
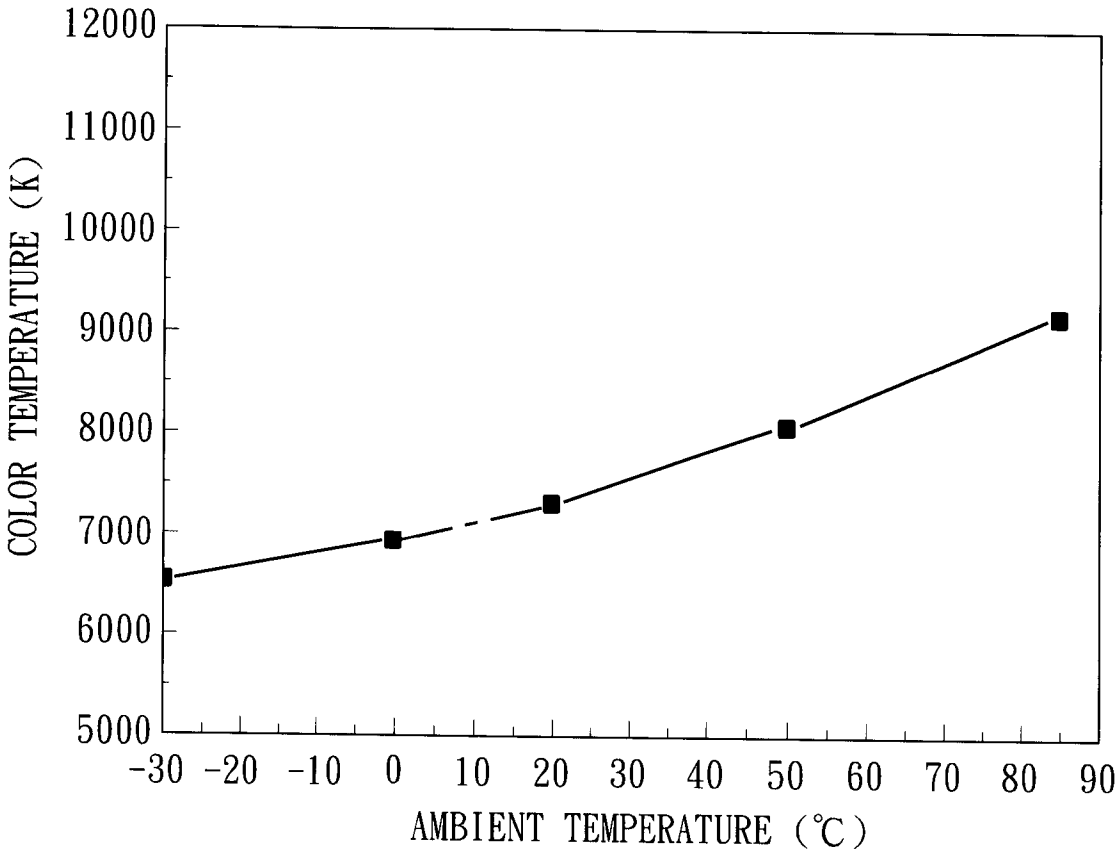
FIG. 1 PRIOR ART
FIG. 1 shows a plot of color temperature vs. ambient temperature obtained for a light emitting module that is driven by a conventional light emitting power control circuit.
Figure 2:
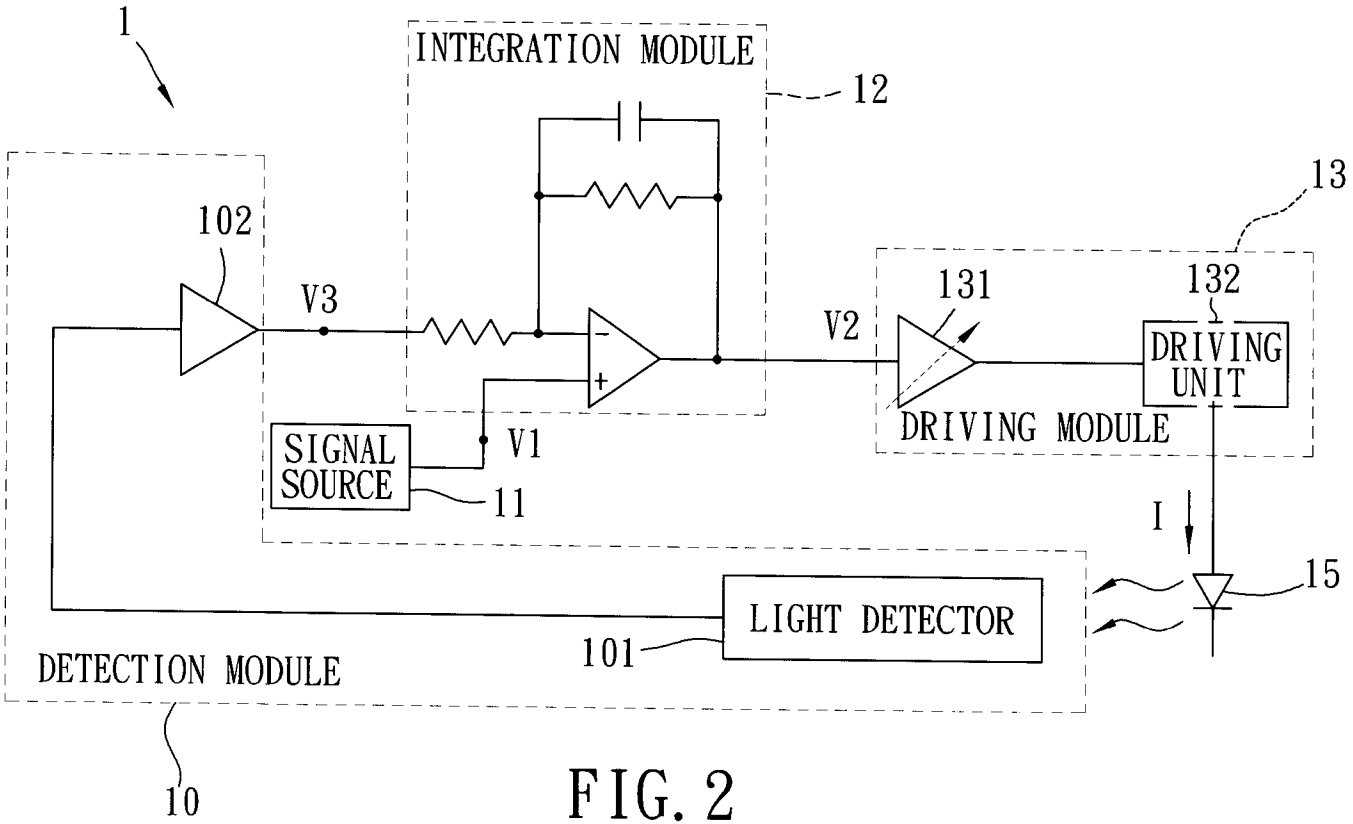
FIG. 2 PRIOR ART
FIG. 2 shows a schematic circuit block diagram of the conventional light emitting power control circuit.
Figure 3:
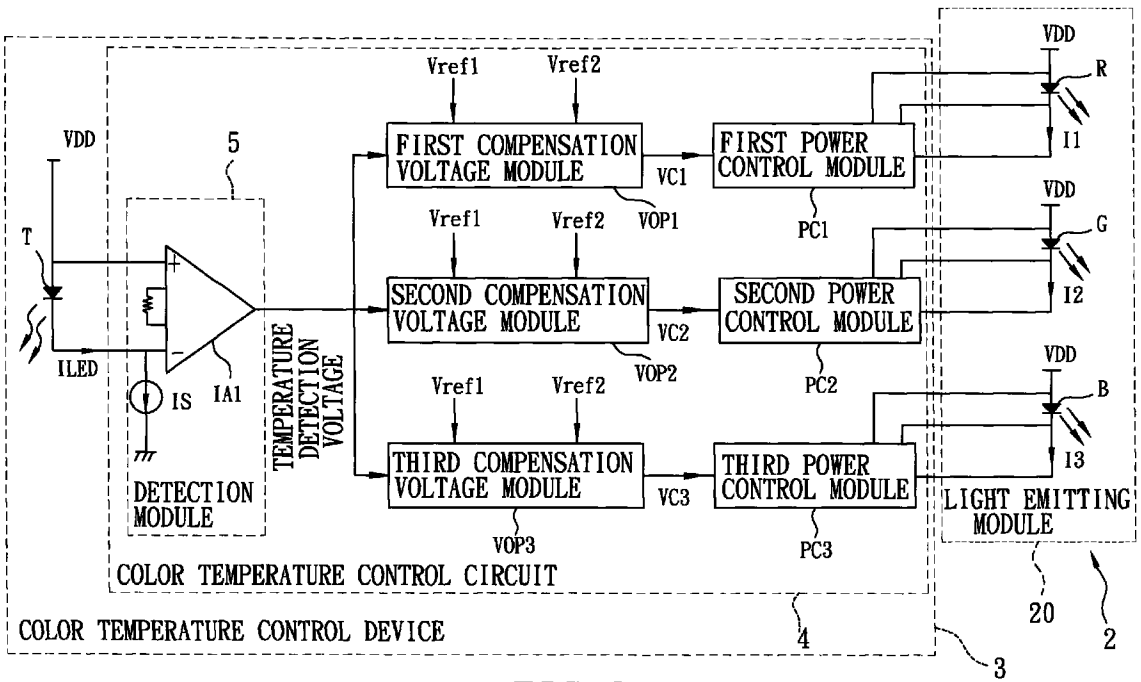
FIG. 3 shows a schematic circuit block diagram of the preferred embodiment of a light emitting system with color temperature stabilization according to the present invention.

Referring to FIG. 3, the preferred embodiment of a light emitting system 2 with color temperature stabilization, according to the present invention, includes a light emitting module 20 and a color temperature control device 3.

The light emitting module 20 includes first, second, and third solid-state light emitting components (R, G, B), which, in this embodiment, are red, green, and blue light emitting diodes, respectively, and has a color temperature related to a color mixing ratio that is dependent on a light emitting power of each of the first, second, and third solid-state light emitting components (R, G, B).

Each of the first, second, and third solid-state light emitting components (R, G, B) has an anode disposed to receive an input bias voltage (VDD), and a cathode, and has a corresponding one of first, second, and third forward voltages (VF1, VF2, VF3) having a magnitude that is in a negative relation to ambient temperature when driven under a constant current condition.

The color temperature control device 3 is connected electrically to the light emitting module 20 for compensating the light emitting module 20 for changes in the color temperature caused by changes in the light emitting powers of the solid-state light emitting components (R, G, B) attributed to changes in the ambient temperature. The color temperature control device 3 includes a reference solid-state light emitting component (T) and a color temperature control circuit 4.

The reference solid-state light emitting component (T) has an anode disposed to receive the input bias voltage (VDD), and a cathode, and has a reference forward voltage (VFT) having a magnitude that is in a negative relation to the ambient temperature when driven under a constant current condition. In this embodiment, the reference solid-state light emitting component (T) has a relationship between forward voltage and ambient temperature substantially identical to that of the first solid-state light emitting component (R), and different from those of the second and third solid-state light emitting components (G, B). That is to say, the reference forward voltage (VFT) has a rate of change with respect to the ambient temperature substantially equal to that of the first forward voltage (VF1), and different from those of the second and third forward voltages (VF2, VF3). Specifically, as a result of a rise in the ambient temperature, the drop in the reference forward voltage (VFT) is substantially equal to that in the first forward voltage (VF1), and different from those in the second and third forward voltages (VF2, VF3). In this embodiment, the reference solid-state light emitting component (T) is a red light emitting diode.

The color temperature control circuit 4 is interconnected electrically between the reference solid-state light emitting component (T) and the light emitting module 20, and includes a detection module 5, a first compensation voltage module (VOP1), a second compensation voltage module (VOP2), a third compensation voltage module (VOP3), a first power control module (PC1), a second power control module (PC2), and a third power control module (PC3).

The detection module 5 includes a current source (IS) and a first instrumentation amplifier (IA). The current source (IS) is connected electrically to the cathode of the reference solid-state light emitting component (T) for providing a constant operating current (ILED) through the reference solid-state light emitting component (T).

The first instrumentation amplifier (IA1) has non-inverting and inverting input terminals connected electrically and respectively to the anode and the cathode of the reference solid-state light emitting component (T) for detecting the reference forward voltage (VFT), is operable to generate a temperature detection voltage according to the reference forward voltage (VFT) detected by the first instrumentation amplifier (IA1), and further has an output terminal for outputting the temperature detection voltage, wherein the temperature detection voltage has a magnitude that is dependent on the reference forward voltage (VFT) detected by the first instrumentation amplifier (IA1). In this embodiment, since the first instrumentation amplifier (IA1) has unity gain, the temperature detection voltage is substantially identical to the reference forward voltage (VFT). Thus, when the ambient temperature changes, the reference forward voltage (VFT) and hence the first forward voltage (VF1) satisfy equation 1

$$VF1=V_{LED1}+\Delta V_{LED1}=VFT=V_{LED}+\Delta V_{LED} \quad (1)$$

where: $V_{LED1}$ and $V_{LED}$ represent a value of the first forward voltage (VF1) and a value of the reference forward voltage (VFT) when the ambient temperature is equal to "t", respectively; and $\Delta V_{LED1}$ and $\Delta V_{LED}$ represent a change in value of the first forward voltage (VF1) and a change in value of the reference forward voltage (VFT) when a variation in ambient temperature is equal to "Δt". In this embodiment, "t" is equal to −30° C.

The second forward voltage (VF2) of the second solid-state light emitting component (G) and the third forward voltage (VF3) of the third solid-state light emitting component (B) respectively satisfy equations 2 and 3

$$VF2=V_{LED2}+\Delta V_{LED2} \quad (2)$$

$$VF3=V_{LED3}+\Delta V_{LED3} \quad (3)$$

where: $V_{LED2}$ and $V_{LED3}$ represent a value of the second forward voltage (VF2) and a value of the third forward voltage (VF3) when the ambient temperature is equal to "t"; and $\Delta V_{LED2}$ and $\Delta V_{LED3}$ represent a change in value of the second forward voltage (VF2) and a change in value of the third forward voltage (VF3) when a change in ambient temperature is equal to "Δt".

Each of the first, second, and third compensation voltage modules (VOP1-VOP3) is connected electrically to the output terminal of the first instrumentation amplifier (IA1) for receiving the temperature detection voltage therefrom, is disposed to receive first and second reference voltages (Vref1, Vref2), and is operable to generate a corresponding one of first, second, and third compensation voltages (VC1-VC3) that is in a negative relation to the reference forward voltage (VFT) according to the temperature detection voltage and the first and second reference voltages (Vref1, Vref2) received by the compensation voltage module (VOP1-VOP3), and a gain of the compensation voltage module (VOP1-VOP3).

The first compensation voltage (VC1) is a function of the temperature detection voltage and the first and second reference voltages (Vref1, Vref2), and is defined by equation 4

$$\begin{aligned} VC1 &= G1\times(Vref1-Vtd)+Vref2 \\ &= G1\times(Vref1-VFT)+Vref2 \\ &= G1\times(Vref1-(V_{LED}+\Delta V_{LED})+Vref2 \end{aligned} \quad (4)$$

where Vtd represents the temperature detection voltage, and G1 represents the gain of the first compensation voltage module (VOP1). Since the first instrumentation amplifier (IA1) has unity gain, the temperature detection voltage is substantially identical to the reference forward voltage (VFT), and hence Vtd=VFT. In this embodiment, since the first reference voltage (Vref1) is set to be equal to the reference forward voltage (VFT) when the ambient temperature is equal to "t", equation 4 may be simplified into equation 5

$$\begin{aligned} VC1 &= G1\times(V_{LED}-(V_{LED}+\Delta V_{LED})+Vref2 \\ &= -G1\times\Delta V_{LED}+Vref2 \end{aligned} \quad (5)$$

Likewise, the second and third compensation voltages (VC2, VC3) may be defined respectively by equations 6 and 7

$$VC2=-G2\times\Delta V_{LED}+Vref2 \quad (6)$$

$$VC3=-G3\times\Delta V_{LED}+Vref2 \quad (7)$$

where G2 and G3 represent the gains of the second and third compensation voltage modules (VOP2, VOP3), respectively.

Each of the first, second, and third power control modules (PC1-PC3) is connected electrically to a corresponding one of the first, second, and third compensation voltage modules (VOP1-VOP3) for receiving a corresponding one of the first, second, and third compensation voltages (VC1-VC3) therefrom, is connected electrically to the anode and the cathode of a corresponding one of the first, second, and third solid-state light emitting components (R, G, B) for detecting a corresponding one of the first, second, and third forward voltages (VF1-VF3), and is operable to provide a corresponding one of first, second, and third driving currents (I1-I3) having a magnitude that is in a positive relation to the ambient temperature through the corresponding one of the first, second, and third solid-state light emitting components (R, G, B) according to the corresponding one of the first, second, and third compensation voltages (VC1-VC3) and the corresponding one of the first, second, and third forward voltages (VF1-VF3) received and detected by the power control module (PC1-PC3).

Figure 4:
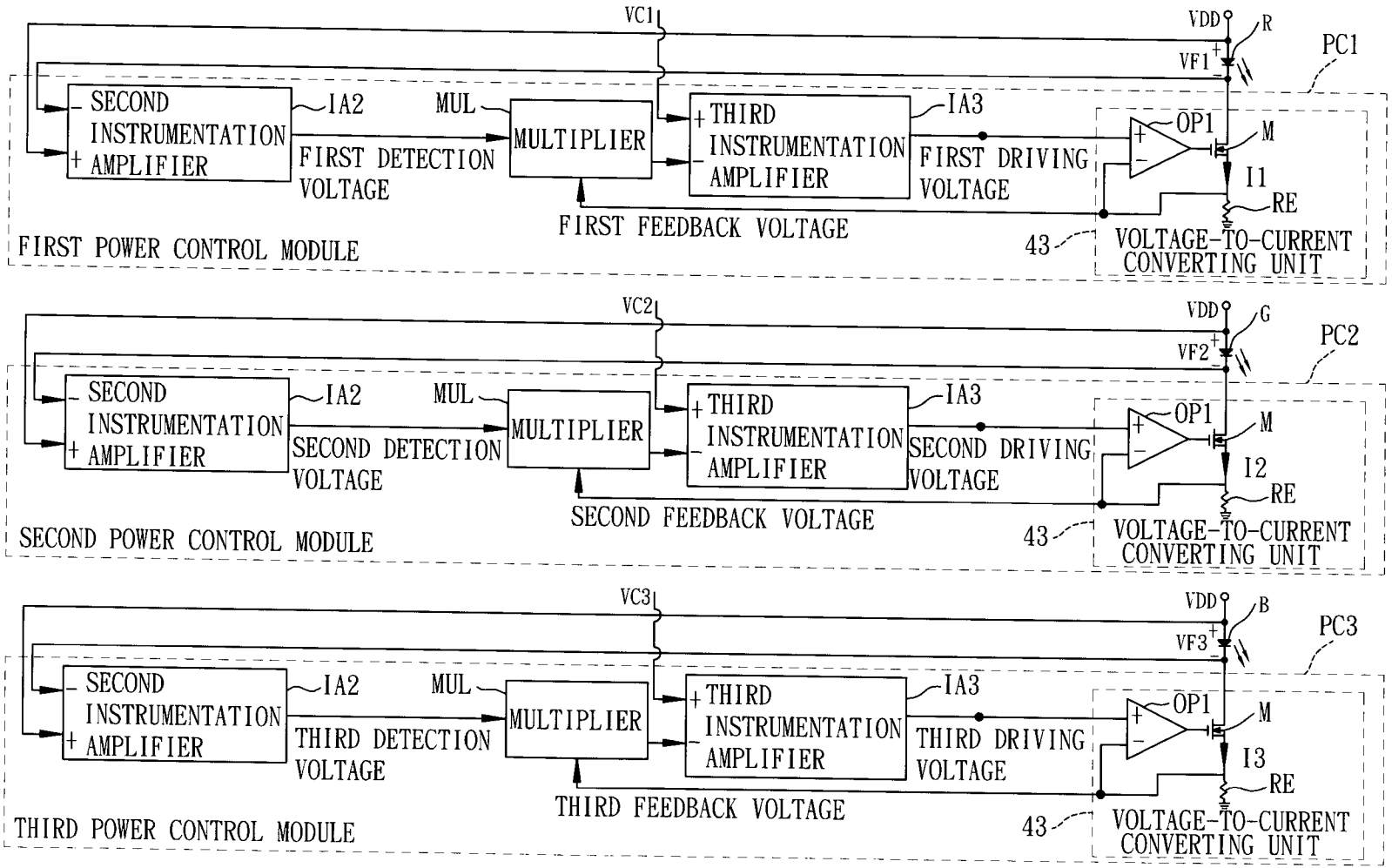
FIG. 4 shows a schematic circuit block diagram of first, second, and third power control modules of a color temperature control circuit of the light emitting system.

Referring to FIG. 4, each of the first, second, and third power control modules (PC1-PC3) includes a voltage-to-current converting unit 43, a second instrumentation amplifier (IA2), a multiplier (MUL), and a third instrumentation amplifier (IA3).

The voltage-to-current converting unit 43 of each of the first, second, and third power control modules (PC1-PC3) is connected electrically to the cathode of the corresponding one of the first, second, and third solid-state light emitting components (R, G, B) for providing the corresponding one of the first, second, and third driving currents (I1-I3) through the corresponding one of the first, second, and third solid-state light emitting components (R, G, B) according to a corresponding one of first, second, and third driving voltages received by the voltage-to-current converting unit 43, is operable to generate a corresponding one of first, second, and third feedback voltages having a magnitude that is in a positive relation to the corresponding one of the first, second, and third driving currents (I1-I3), and includes a transistor (M), an operational amplifier (OP1), and a resistor (RE) that has a resistance value of $R_E$.

The transistor (M) has a first terminal that is connected electrically to the cathode of the corresponding one of the first, second, and third solid-state light emitting components (R, G, B), a second terminal that is connected to ground via the resistor (RE), and a control terminal. A voltage at the second terminal of the transistor (M), which is related to the resistance value $R_E$ of the resistor (RE), serves as the corresponding one of the first, second, and third feedback voltages. In this embodiment, the transistor (M) is an n-type metal-oxide-semiconductor field-effect transistor (MOSFET) having a drain terminal, a source terminal, and a gate terminal that serve as the first terminal, the second terminal, and the control terminal, respectively.

The operational amplifier (OP1): has an inverting input terminal connected electrically to the second terminal of the transistor (M) for receiving the corresponding one of the first, second, and third feedback voltages therefrom, and a non-inverting input terminal for receiving the corresponding one of the first, second, and third driving voltages; is operable to generate a corresponding one of first, second, and third control voltages according to a difference between the corresponding one of the first, second, and third driving voltages and the corresponding one of the first, second, and third feedback voltages received by the operational amplifier (OP1); and further has an output terminal connected electrically to the control terminal of the transistor (M) for providing the corresponding one of the first, second, and third control voltages to the transistor (M) such that the transistor (M) is controlled to turn on for provision of the corresponding one of the first, second, and third driving currents (I1-I3) through the corresponding one of the first, second, and third solid-state light emitting components (R, G, B) via the transistor (M) according to the corresponding one of the first, second, and third control voltages received by the transistor (M).

Each of the first, second, and third feedback voltages corresponds to a product of the corresponding one of the first, second, and third driving currents (I1-I3) and the resistance value $R_E$ of the resistor (RE), i.e., VRE1=I1×$R_E$, VRE2=I2×$R_E$, and VRE3=I3×$R_E$, where VRE1, VRE2, and VRE3 represent the first, second, and third feedback voltages, respectively. Furthermore, due to a virtual short circuit effect between the inverting and non-inverting input terminals of the operational amplifier (OP1) of each of the first, second, and third power control modules (PC1-PC3), each of the first, second, and third driving currents (I1-I3) is equal to a result of division of the corresponding one of the first, second, and third driving voltages by the resistance value $R_E$. That is, the first, second, and third driving currents (I1-I3) are equal to VD1/$R_E$, VD2/$R_E$, and VD3/$R_E$, respectively, where VD1, VD2, and VD3 represent the first, second, and third driving voltages, respectively.

The second instrumentation amplifier (IA2) of each of the first, second, and third power control modules (PC1-PC3): has a non-inverting input terminal and an inverting input terminal connected electrically and respectively to the anode and the cathode of the corresponding one of the first, second, and third solid-state light emitting components (R, G, B) for detecting the corresponding one of the first, second, and third forward voltages (VF1-VF3); is operable to generate a corresponding one of first, second, and third detection voltages according to the corresponding one of the first, second, and third forward voltages (VF1-VF3) detected by the second instrumentation amplifier (IA2); and further has an output terminal for outputting the corresponding one of the first, second, and third detection voltages, which has a magnitude that is in a positive relation to the corresponding one of the first, second, and third forward voltages (VF1-VF3) detected by the second instrumentation amplifier (IA2). In this embodiment, the second instrumentation amplifier (IA2) of each of the first, second, and third power control modules (PC1-PC3) has unity gain, such that the first, second, and third detection voltages are substantially identical to the first, second, and third forward voltages (VF1-VF3), respectively.

The multiplier (MUL) of each of the first, second, and third power control modules (PC1-PC3) is connected electrically to the output terminal of the corresponding second instrumentation amplifier (IA2) for receiving the corresponding one of the first, second, and third detection voltages from the corresponding second instrumentation amplifier (IA2), is connected electrically to the corresponding voltage-to-current converting unit 43 for receiving the corresponding one of the first, second, and third feedback voltages from the corresponding voltage-to-current converting unit 43, and is operable to generate a corresponding one of first, second, and third product voltages according to a product of the corresponding one of the first, second, and third detection voltages and the corresponding one of the first, second, and third feedback voltages received by the multiplier (MUL) according to a corresponding one of equations 8 to 10

$$\begin{aligned} VMUL1 &= V\det1 \times VRE1 \\ &= VF1 \times VRE1 \\ &= (V_{LED1} + \Delta V_{LED1}) \times (I1 \times R_E) \\ &= (V_{LED} + \Delta V_{LED}) \times (I1 \times R_E) \end{aligned} \tag{8}$$

$$\begin{aligned} VMUL2 &= V\det2 \times VRE2 \\ &= VF2 \times VRE2 \\ &= (V_{LED2} + \Delta V_{LED2}) \times (I2 \times R_E) \end{aligned} \tag{9}$$

$$\begin{aligned} VMUL3 &= V\det3 \times VRE3 \\ &= VF3 \times VRE3 \\ &= (V_{LED3} + \Delta V_{LED3}) \times (I3 \times R_E) \end{aligned} \tag{10}$$

where: VMUL1, VMUL2, and VMUL3 represent the first, second, and third product voltages, respectively; Vdet1, Vdet2, and Vdet3 represent the first, second, and third detection voltages, which, in this embodiment, are substantially identical to the first, second, and third forward voltages (VF1-VF3), respectively; and VRE1, VRE2, and VRE3 represent the first, second, and third feedback voltages, respectively.

The third instrumentation amplifier (IA3) of each of the first, second, and third power control modules (PC1-PC3): has a non-inverting input terminal connected electrically to the corresponding one of the first, second, and third compensation voltage modules (VOP1-VOP3) for receiving the corresponding one of the first, second, and third compensation voltages (VC1-VC3) from the corresponding one of the first, second, and third compensation voltage modules (VOP1-VOP3), and an inverting input terminal connected electrically to the corresponding multiplier (MUL) for receiving the corresponding one of the first, second, and third product voltages (VMUL1-VMUL3) from the corresponding multiplier (MUL); is operable to generate the corresponding one of the first, second, and third driving voltages according to a difference between the corresponding one of the first, second, and third compensation voltages (VC1-VC3) and the corresponding one of the first, second, and third product voltages (VMUL1-VMUL3) received by the third instrumentation amplifier (IA3); and further has an output terminal connected electrically to the non-inverting input terminal of the operational amplifier (OP1) of the corresponding voltage-to-current converting unit 43 for outputting the corresponding one of the first, second, and third driving voltages to the operational amplifier (OP1). In this embodiment, the third instrumentation amplifier (IA3) has unity gain.

Each of the first, second, and third driving voltages is related to the corresponding one of the first, second, and third compensation voltages (VC1-VC3) and the corresponding one of the first, second, and third product voltages (VMUL1-VMUL3) according to a corresponding one of equations 11 to 13

$$VD1 = VC1 - VMUL1 = (-G1 \times \Delta V_{LED} + Vref2) - (V_{LED} + \Delta V_{LED}) \times (I1 \times R_E) \quad (11)$$

$$VD2 = VC2 - VMUL2 = (-G2 \times \Delta V_{LED2} + Vref2) - (V_{LED2} + \Delta V_{LED2}) \times (I2 \times R_E) \quad (12)$$

$$VD3 = VC3 - VMUL3 = (-G3 \times \Delta V_{LED3} + Vref2) - (V_{LED3} + \Delta V_{LED3}) \times (I3 \times R_E) \quad (13)$$

where VD1, VD2, and VD3 represent the first, second, and third driving voltages, respectively.

Next, equations 14 to 16, which respectively define the first, second, and third operating currents (I1-I3), may be obtained by respectively substituting $I1=VD1/R_E$, $I2=VD2/R_E$, and $I3=VD3/R_E$ into equations 11 to 13

$$I1 = \frac{(-G1 \times \Delta V_{LED} + Vref2)}{(1 + V_{LED} + \Delta V_{LED}) \times R_E} \quad (14)$$

$$I2 = \frac{(-G2 \times \Delta V_{LED2} + Vref2)}{(1 + V_{LED2} + \Delta V_{LED2}) \times R_E} \quad (15)$$

$$I3 = \frac{(-G3 \times \Delta V_{LED3} + Vref2)}{(1 + V_{LED3} + \Delta V_{LED3}) \times R_E} \quad (16)$$

It can be understood from equations 14 to 16 that, when the ambient temperature rises, the change in value of each of the first, second, and third forward voltages (VF1-VF3) is negative (i.e., $\Delta V_{LED}<0$, $\Delta V_{LED2}<0$, and $\Delta V_{LED3}<0$), causing each of first, second, and third forward voltages (VF1-VF3) to decrease, which, in turn, causes each of the first, second, and third driving currents (I1-I3) to increase. On the other hand, when the ambient temperature falls, the change in value of each of the first, second, and third forward voltages (VF1-VF3) is positive (i.e., $\Delta V_{LED}>0$, $\Delta V_{LED2}>0$, and $\Delta V_{LED3}>0$), causing each of the first, second, and third forward voltages (VF1-VF3) to increase, which, in turn, causes each of the first, second, and third driving currents (I1-I3) to decrease. Thus, each of the first, second, and third driving currents (I1-I3) changes in response to changes in the ambient temperature so as to stabilize the light emitting power of each of the first, second, and third solid-state light emitting components (R, G, B), thereby stabilizing the color mixing ratio and hence the color temperature of the light emitting module 20.

Figure 5:
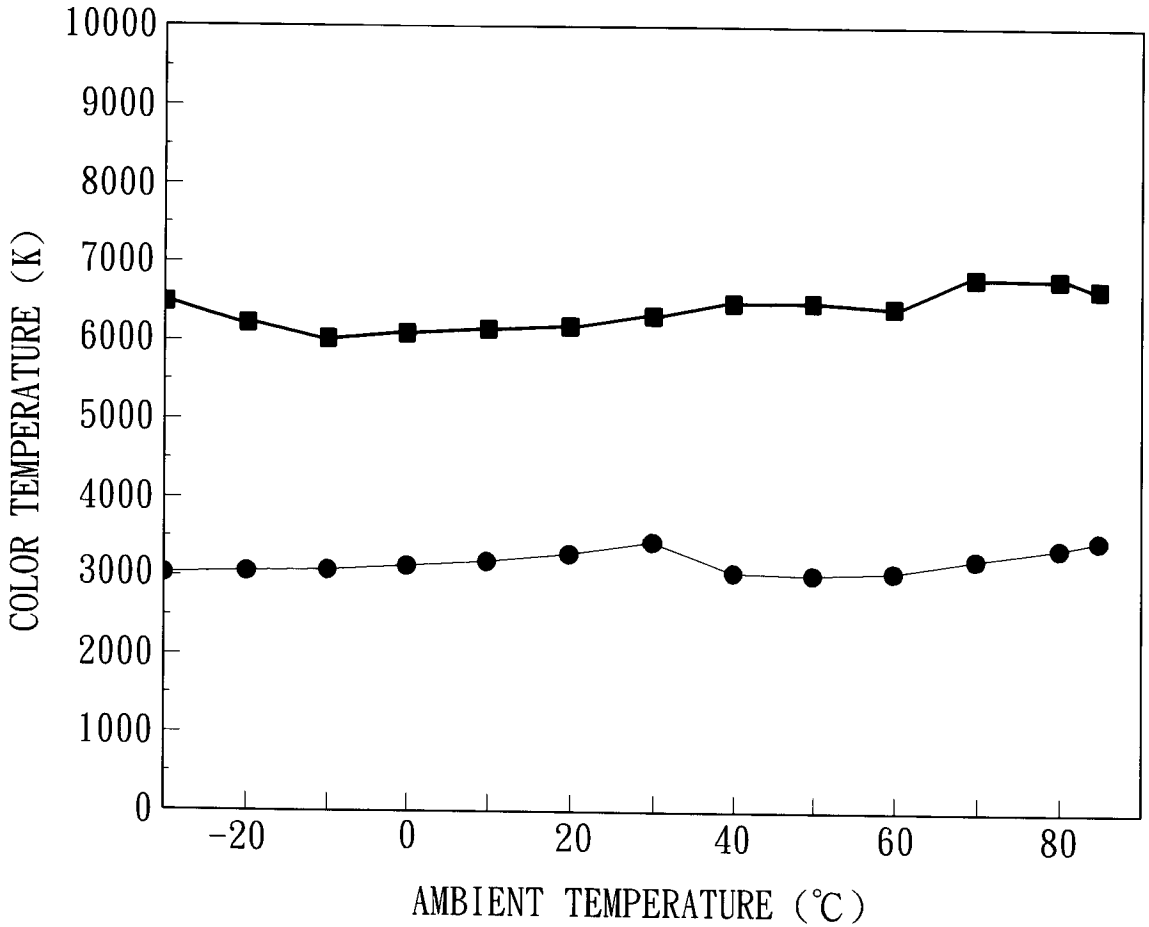
FIG. 5 shows a plot of color temperature vs. ambient temperature obtained for the light emitting system of the preferred embodiment.

FIG. 5 shows plots of color temperature vs. ambient temperature obtained for the light emitting system 2 within the temperature range of −30° C. to 80° C.

In summary, through detecting the reference forward voltage (VFT) of the reference solid-state light emitting component (T) using the detection module 5, the light emitting system 2 of the preferred embodiment of the present invention is capable of alleviating the aforesaid drawbacks of the prior art and hence achieve a light emitting power stabilization effect and hence a better color temperature stabilization effect.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A light emitting system with color temperature stabilization, comprising:

a light emitting module including a first solid-state light emitting component of a first primary color, said first solid-state light emitting component having an anode and a cathode, one of which is disposed to receive an input voltage, and having a first forward voltage that has a magnitude dependent on ambient temperature when driven under a constant current condition, and a second solid-state light emitting component of a second primary color, said second solid-state light emitting component having an anode and a cathode, one of which is disposed to receive the input voltage, and having a second forward voltage that has a magnitude dependent on the ambient temperature when driven under a constant current condition; and a color temperature control device including a reference solid-state light emitting component having an anode and a cathode, one of which is disposed to receive the input voltage, and having a reference forward voltage that has a magnitude dependent on the ambient temperature when driven under a constant current condition, and a color temperature control circuit including a detection module including a current source that is connected electrically to the other of said anode and said cathode of said reference solid-state light emitting component for providing a constant operating current through said reference solid-state light emitting component, and a first instrumentation amplifier that has first and second input terminals connected electrically and respectively to said anode and said cathode of said reference solid-state light emitting component for detecting the reference forward voltage, that is operable to generate a temperature detection voltage according to the reference forward voltage detected by said first instrumentation amplifier, and that further has an output terminal for outputting the temperature detection voltage, the temperature detection voltage having a magnitude that is dependent on the reference forward voltage detected by said first instrumentation amplifier, a first compensation voltage module connected electrically to said detection module for receiving the temperature detection voltage from said detection module, adapted to receive first and second reference voltages, and operable to generate a first compensation voltage based on a gain of said first compensation voltage module, the temperature detection voltage and the first and second reference voltages received by said first compensation voltage module, the first compensation voltage being related to the reference forward voltage, a second compensation voltage module connected electrically to said detection module for receiving the temperature detection voltage from said detection module, adapted to receive the first and second reference voltages, and operable to generate a second compensation voltage based on a gain of said second compensation voltage module, the temperature detection voltage and the first and second reference voltages received by said second compensation voltage module, the second compensation voltage being related to the reference forward voltage, a first power control module connected electrically to said first compensation voltage module for receiving the first compensation voltage from said first compensation voltage module, connected electrically to said anode and said cathode of said first solid-state light emitting component for detecting the first forward voltage, and operable to provide a first driving current through said first solid-state light emitting component according to the first compensation voltage and the first forward voltage received and detected by said first power control module for stabilizing a light emitting power of said first solid-state light emitting component with respect to the ambient temperature, and a second power control module connected electrically to said second compensation voltage module for receiving the second compensation voltage from said second compensation voltage module, connected electrically to said anode and said cathode of said second solid-state light emitting component for detecting the second forward voltage, and operable to provide a second driving current through said second solid-state light emitting component according to the second compensation voltage and the second forward voltage received and detected by said second power control module for stabilizing a light emitting power of said second solid-state light emitting component with respect to the ambient temperature.

2. The light emitting system as claimed in claim 1, wherein each of said first and second power control modules includes:

a voltage-to-current converting unit that is connected electrically to the other of said anode and said cathode of the corresponding one of said first and second solid-state light emitting components for providing the corresponding one of the first and second driving currents through the corresponding one of said first and second solid-state light emitting components according to a corresponding one of first and second driving voltages received by said voltage-to-current converting unit, and that is operable to generate a corresponding one of first and second feedback voltages having a magnitude dependent on the corresponding one of the first and second driving currents;

a second instrumentation amplifier that has first and second input terminals connected electrically and respectively to said anode and said cathode of the corresponding one of said first and second solid-state light emitting components for detecting the corresponding one of the first and second forward voltages, that is operable to generate a corresponding one of first and second detection voltages according to the corresponding one of the first and second forward voltages detected by said second instrumentation amplifier, and that further has an output terminal for outputting the corresponding one of the first and second detection voltages, which has a magnitude that is dependent on the corresponding one of the first and second forward voltages detected by said second instrumentation amplifier;

a multiplier connected electrically to said output terminal of said second instrumentation amplifier for receiving the corresponding one of the first and second detection voltages from said second instrumentation amplifier, connected electrically to said voltage-to-current converting unit for receiving the corresponding one of the first and second feedback voltages from said voltage-to-current converting unit, and operable to generate a corresponding one of first and second product voltages according to a product of the corresponding one of the first and second detection voltages and the corresponding one of the first and second feedback voltages received by said multiplier; and a third instrumentation amplifier that has a first input terminal connected electrically to the corresponding one of said first and second compensation voltage modules for receiving the corresponding one of the first and second compensation voltages from the corresponding one of said first and second compensation voltage modules, and a second input terminal connected electrically to said multiplier for receiving the corresponding one of the first and second product voltages from said multiplier, that is operable to generate the corresponding one of the first and second driving voltages according to a difference between the corresponding one of the first and second compensation voltages and the corresponding one of the first and second product voltages received by said third instrumentation amplifier, and that further has an output terminal connected electrically to said voltage-to-current converting unit for outputting the corresponding one of the first and second driving voltages to said voltage-to-current converting unit.

3. The light emitting system as claimed in claim 2, wherein said voltage-to-current converting unit of each of said first and second power control modules includes:

a resistor;

a transistor that has a first terminal connected electrically to the other of said anode and said cathode of the corresponding one of said first and second solid-state light emitting components, a second terminal connected electrically to ground via said resistor, and a control terminal, a voltage at said second terminal of said transistor of said power control module serving as the corresponding one of the first and second feedback voltages; and an operational amplifier that has a first input terminal connected electrically to said output terminal of said third instrumentation amplifier of said power control module for receiving the corresponding one of the first and second driving voltages from said third instrumentation amplifier, and a second input terminal connected electrically to said second terminal of said transistor for receiving the corresponding one of the first and second feedback voltages from said transistor, that is operable to generate a corresponding one of first and second control voltages according to a difference between the corresponding one of the first and second driving voltages and the corresponding one of the first and second feedback voltages received by said operational amplifier, and that further has an output terminal connected electrically to said control terminal of said transistor for providing the corresponding one of the first and second control voltages to said transistor such that said transistor is controlled to turn on for provision of the corresponding one of the first and second driving currents through the corresponding one of said first and second solid-state light emitting components via said transistor according to the corresponding one of the first and second control voltages received by said transistor.

4. The light emitting system as claimed in claim 3, wherein said transistor of each of said first and second power control modules is an n-type metal-oxide-semiconductor field-effect transistor having a drain terminal, a source terminal, and a gate terminal that serve as said first terminal, said second terminal, and said control terminal of said transistor, respectively.

5. The light emitting system as claimed in claim 1, wherein each of said first, second, and reference solid-state light emitting components is a light emitting diode.

6. A color temperature control device adapted to be connected electrically to a light emitting module that includes first and second solid-state light emitting components of respective primary colors, the first solid-state light emitting component having an anode and a cathode, one of which is disposed to receive an input voltage, and having a first forward voltage that has a magnitude dependent on ambient temperature when driven under a constant current condition, the second solid-state light emitting component having an anode and a cathode, one of which is disposed to receive the input voltage, and having a second forward voltage that has a magnitude dependent on the ambient temperature when driven under a constant current condition, said color temperature control device comprising:

a reference solid-state light emitting component having an anode and a cathode, one of which is disposed to receive the input voltage, and having a reference forward voltage that has a magnitude dependent on the ambient temperature when driven under a constant current condition; and a color temperature control circuit including a detection module including a current source that is connected electrically to the other of said anode and said cathode of said reference solid-state light emitting component for providing a constant operating current through said reference solid-state light emitting component, and a first instrumentation amplifier that has first and second input terminals connected electrically and respectively to said anode and said cathode of said reference solid-state light emitting component for detecting the reference forward voltage, that is operable to generate a temperature detection voltage according to the reference forward voltage detected by said first instrumentation amplifier, and that further has an output terminal for outputting the temperature detection voltage, the temperature detection voltage having a magnitude that is dependent on the reference forward voltage detected by said first instrumentation amplifier, a first compensation voltage module connected electrically to said detection module for receiving the temperature detection voltage from said detection module, adapted to receive first and second reference voltages, and operable to generate a first compensation voltage based on a gain of said first compensation voltage module, the temperature detection voltage and the first and second reference voltages received by said first compensation voltage module, the first compensation voltage being related to the reference forward voltage, a second compensation voltage module connected electrically to said detection module for receiving the temperature detection voltage from said detection module, adapted to receive the first and second reference voltages, and operable to generate a second compensation voltage based on a gain of said second compensation voltage module, the temperature detection voltage and the first and second reference voltages received by said second compensation voltage module, the second compensation voltage being related to the reference forward voltage, a first power control module connected electrically to said first compensation voltage module for receiving the first compensation voltage from said first compensation voltage module, adapted to be connected electrically to the anode and the cathode of the first solid-state light emitting component for detecting the first forward voltage, and operable to provide a first driving current through the first solid-state light emitting component according to the first compensation voltage and the first forward voltage received and detected by said first power control module for stabilizing a light emitting power of the first solid-state light emitting component with respect to the ambient temperature, and a second power control module connected electrically to said second compensation voltage module for receiving the second compensation voltage from said second compensation voltage module, adapted to be connected electrically to the anode and the cathode of the second solid-state light emitting component for detecting the second forward voltage, and operable to provide a second driving current through the second solid-state light emitting component according to the second compensation voltage and the second forward voltage received and detected by said second power control module for stabilizing a light emitting power of the second solid-state light emitting component with respect to the ambient temperature.

7. The color temperature control device as claimed in claim 6, wherein each of said first and second power control modules includes:

a voltage-to-current converting unit that is adapted to be connected electrically to the other of the anode and the cathode of the corresponding one of the first and second solid-state light emitting components for providing the corresponding one of the first and second driving currents through the corresponding one of the first and second solid-state light emitting components according to a corresponding one of first and second driving voltages received by said voltage-to-current converting unit, and that is operable to generate a corresponding one of first and second feedback voltages having a magnitude dependent on the corresponding one of the first and second driving currents;

a second instrumentation amplifier that has first and second input terminals adapted to be connected electrically and respectively to the anode and the cathode of the corresponding one of the first and second solid-state light emitting components for detecting the corresponding one of the first and second forward voltages, that is operable to generate a corresponding one of first and second detection voltages according to the corresponding one of the first and second forward voltages detected by said second instrumentation amplifier, and that further has an output terminal for outputting the corresponding one of the first and second detection voltages, which has a magnitude that is dependent on the corresponding one of the first and second forward voltages detected by said second instrumentation amplifier;

a multiplier connected electrically to said output terminal of said second instrumentation amplifier for receiving the corresponding one of the first and second detection voltages from said second instrumentation amplifier, connected electrically to said voltage-to-current converting unit for receiving the corresponding one of the first and second feedback voltages from said voltage-to-current converting unit, and operable to generate a corresponding one of first and second product voltages according to a product of the corresponding one of the first and second detection voltages and the corresponding one of the first and second feedback voltages received by said multiplier; and a third instrumentation amplifier that has a first input terminal connected electrically to the corresponding one of said first and second compensation voltage modules for receiving the corresponding one of the first and second compensation voltages from the corresponding one of said first and second compensation voltage modules, and a second input terminal connected electrically to said multiplier for receiving the corresponding one of the first and second product voltages from said multiplier, that is operable to generate the corresponding one of the first and second driving voltages according to a difference between the corresponding one of the first and second compensation voltages and the corresponding one of the first and second product voltages received by said third instrumentation amplifier, and that further has an output terminal connected electrically to said voltage-to-current converting unit for outputting the corresponding one of the first and second driving voltages to said voltage-to-current converting unit.

8. The color temperature control device as claimed in claim 7, wherein said voltage-to-current converting unit of each of said first and second power control modules includes:

a resistor;

a transistor that has a first terminal adapted to be connected electrically to the other of the anode and the cathode of the corresponding one of the first and second solid-state light emitting components, a second terminal connected electrically to ground via said resistor, and a control terminal, a voltage at said second terminal of said transistor of said power control module serving as the corresponding one of the first and second feedback voltages; and an operational amplifier that has a first input terminal connected electrically to said output terminal of said third instrumentation amplifier of said power control module for receiving the corresponding one of the first and second driving voltages from said third instrumentation amplifier, and a second input terminal connected electrically to said second terminal of said transistor for receiving the corresponding one of the first and second feedback voltages from said transistor, that is operable to generate a corresponding one of first and second control voltages according to a difference between the corresponding one of the first and second driving voltages and the corresponding one of the first and second feedback voltages received by said operational amplifier, and that further has an output terminal connected electrically to said control terminal of said transistor for providing the corresponding one of the first and second control voltages to said transistor such that said transistor is controlled to turn on for provision of the corresponding one of the first and second driving currents through the corresponding one of the first and second solid-state light emitting components via said transistor according to the corresponding one of the first and second control voltages received by said transistor.

9. The color temperature control device as claimed in claim 8, wherein said transistor of each of said first and second power control modules is an n-type metal-oxide-semiconductor field-effect transistor having a drain terminal, a source terminal, and a gate terminal that serve as said first terminal, said second terminal, and said control terminal of said transistor, respectively.

10. The color temperature control device as claimed in claim 6, wherein said reference solid-state light emitting component is a light emitting diode.

11. A color temperature control circuit adapted to be connected electrically to a reference solid-state light emitting component, and to a light emitting module that includes first and second solid-state light emitting components of respective primary colors, the first solid-state light emitting component having an anode and a cathode, one of which is disposed to receive an input voltage, and having a first forward voltage that has a magnitude dependent on ambient temperature when driven under a constant current condition, the second solid-state light emitting component having an anode and a cathode, one of which is disposed to receive the input voltage, and having a second forward voltage that has a magnitude dependent on the ambient temperature when driven under a constant current condition, the reference solid-state light emitting component having an anode and a cathode, one of which is disposed to receive the input voltage, and having a reference forward voltage that has a magnitude dependent on the ambient temperature when driven under a constant current condition, said color temperature control circuit comprising:

a detection module including a current source that is adapted to be connected electrically to the other of the anode and the cathode of the reference solid-state light emitting component for providing a constant operating current through the reference solid-state light emitting component, and a first instrumentation amplifier that has first and second input terminals adapted to be connected electrically and respectively to the anode and the cathode of the reference solid-state light emitting component for detecting the reference forward voltage, that is operable to generate a temperature detection voltage according to the reference forward voltage detected by said first instrumentation amplifier, and that further has an output terminal for outputting the temperature detection voltage, the temperature detection voltage having a magnitude that is dependent on the reference forward voltage detected by said first instrumentation amplifier;

a first compensation voltage module connected electrically to said detection module for receiving the temperature detection voltage from said detection module, adapted to receive first and second reference voltages, and operable to generate a first compensation voltage based on a gain of said first compensation voltage module, the temperature detection voltage and the first and second reference voltages received by said first compensation voltage module, the first compensation voltage being related to the reference forward voltage;

a second compensation voltage module connected electrically to said detection module for receiving the temperature detection voltage from said detection module, adapted to receive the first and second reference voltages, and operable to generate a second compensation voltage based on a gain of said second compensation voltage module, the temperature detection voltage and the first and second reference voltages received by said second compensation voltage module, the second compensation voltage being related to the reference forward voltage;

a first power control module connected electrically to said first compensation voltage module for receiving the first compensation voltage from said first compensation voltage module, adapted to be connected electrically to the anode and the cathode of the first solid-state light emitting component for detecting the first forward voltage, and operable to provide a first driving current through the first solid-state light emitting component according to the first compensation voltage and the first forward voltage received and detected by said first power control module for stabilizing a light emitting power of the first solid-state light emitting component with respect to the ambient temperature; and a second power control module connected electrically to said second compensation voltage module for receiving the second compensation voltage from said second compensation voltage module, adapted to be connected electrically to the anode and the cathode of the second solid-state light emitting component for detecting the second forward voltage, and operable to provide a second driving current through the second solid-state light emitting component according to the second compensation voltage and the second forward voltage received and detected by said second power control module for stabilizing a light emitting power of the second solid-state light emitting component with respect to the ambient temperature.

12. The color temperature control circuit as claimed in claim 11, wherein each of said first and second power control modules includes:

a voltage-to-current converting unit that is adapted to be connected electrically to the other of the anode and the cathode of the corresponding one of the first and second solid-state light emitting components for providing the corresponding one of the first and second driving currents through the corresponding one of the first and second solid-state light emitting components according to a corresponding one of first and second driving voltages received by said voltage-to-current converting unit, and that is operable to generate a corresponding one of first and second feedback voltages having a magnitude dependent on the corresponding one of the first and second driving currents;

a second instrumentation amplifier that has first and second input terminals adapted to be connected electrically and respectively to the anode and the cathode of the corresponding one of the first and second solid-state light emitting components for detecting the corresponding one of the first and second forward voltages, that is operable to generate a corresponding one of first and second detection voltages according to the corresponding one of the first and second forward voltages detected by said second instrumentation amplifier, and that further has an output terminal for outputting the corresponding one of the first and second detection voltages, which has a magnitude that is dependent on the corresponding one of the first and second forward voltages detected by said second instrumentation amplifier;

a multiplier connected electrically to said output terminal of said second instrumentation amplifier for receiving the corresponding one of the first and second detection voltages from said second instrumentation amplifier, connected electrically to said voltage-to-current converting unit for receiving the corresponding one of the first and second feedback voltages from said voltage-to-current converting unit, and operable to generate a corresponding one of first and second product voltages according to a product of the corresponding one of the first and second detection voltages and the corresponding one of the first and second feedback voltages received by said multiplier; and a third instrumentation amplifier that has a first input terminal connected electrically to the corresponding one of said first and second compensation voltage modules for receiving the corresponding one of the first and second compensation voltages from the corresponding one of said first and second compensation voltage modules, and a second input terminal connected electrically to said multiplier for receiving the corresponding one of the first and second product voltages from said multiplier, that is operable to generate the corresponding one of the first and second driving voltages according to a difference between the corresponding one of the first and second compensation voltages and the corresponding one of the first and second product voltages received by said third instrumentation amplifier, and that further has an output terminal connected electrically to said voltage-to-current converting unit for outputting the corresponding one of the first and second driving voltages to said voltage-to-current converting unit.

13. The color temperature control circuit as claimed in claim 12, wherein said voltage-to-current converting unit of each of said first and second power control modules includes:

a resistor;

a transistor that has a first terminal adapted to be connected electrically to the other of the anode and the cathode of the corresponding one of the first and second solid-state light emitting components, a second terminal connected electrically to ground via said resistor, and a control terminal, a voltage at said second terminal of said transistor of said power control module serving as the corresponding one of the first and second feedback voltages; and an operational amplifier that has a first input terminal connected electrically to said output terminal of said third instrumentation amplifier of said power control module for receiving the corresponding one of the first and second driving voltages from said third instrumentation amplifier, and a second input terminal connected electrically to said second terminal of said transistor for receiving the corresponding one of the first and second feedback voltages from said transistor, that is operable to generate a corresponding one of first and second control voltages according to a difference between the corresponding one of the first and second driving voltages and the corresponding one of the first and second feedback voltages received by said operational amplifier, and that further has an output terminal connected electrically to said control terminal of said transistor for providing the corresponding one of the first and second control voltages to said transistor such that said transistor is controlled to turn on for provision of the corresponding one of the first and second driving currents through the corresponding one of the first and second solid-state light emitting components via said transistor according to the corresponding one of the first and second control voltages received by said transistor.

14. The color temperature control circuit as claimed in claim 13, wherein said transistor of each of said first and second power control modules is an n-type metal-oxide-semiconductor field-effect transistor having a drain terminal, a source terminal, and a gate terminal that serve as said first terminal, said second terminal, and said control terminal of said transistor, respectively.

* * * * *